US010336496B2

(12) United States Patent
Zimmer

(10) Patent No.: US 10,336,496 B2
(45) Date of Patent: Jul. 2, 2019

(54) BEVERAGE GLASS AND BEVERAGE GLASS ASSEMBLY

(75) Inventor: Matt Zimmer, Newport Beach, CA (US)

(73) Assignee: STACKED WINES LLC, Newport Beach, CA (US)

( * ) Notice: Subject to any disclaimer, the term of this patent is extended or adjusted under 35 U.S.C. 154(b) by 808 days.

(21) Appl. No.: 13/474,376

(22) Filed: May 17, 2012

(65) Prior Publication Data

US 2012/0292315 A1 Nov. 22, 2012

Related U.S. Application Data

(63) Continuation-in-part of application No. 29/411,983, filed on Jan. 27, 2012, now Pat. No. Des. 674,236,
(Continued)

(51) Int. Cl.
*B65D 21/032* (2006.01)
*B65D 1/10* (2006.01)
(Continued)

(52) U.S. Cl.
CPC ..... *B65D 1/10* (2013.01); *A47G 19/2205* (2013.01); *A47G 19/2255* (2013.01);
(Continued)

(58) Field of Classification Search
CPC ..... A47G 19/2205; A47G 19/2255; B65D 21/0204; B65D 21/0231; B65D 21/0228;
(Continued)

(56) References Cited

U.S. PATENT DOCUMENTS

D140,658 S 3/1945 Erbe
2,539,514 A 1/1951 Jenett
(Continued)

FOREIGN PATENT DOCUMENTS

CN 201317492 Y 9/2009
DE 296 22 585 U1 4/1998
(Continued)

OTHER PUBLICATIONS

Supplementary European Search Report regarding corresponding European Patent Application No. 12 78 5980 dated Feb. 11, 2015.
(Continued)

*Primary Examiner* — Andrew D Perreault
(74) *Attorney, Agent, or Firm* — Brinks Gilson & Lione; John C. Freeman

(57) ABSTRACT

A beverage container assembly including a first beverage container having a first vessel body that has a first base having a first perimeter and a first side wall connected to the first base, wherein the first side wall includes a connecting member. The first beverage container including a first rim defined on the first side wall distal to the first base. The assembly further including a second beverage container that includes a second vessel body that has a second base having a second perimeter and a second side wall connected to the second base. The second side wall includes an engagement member that engages with the connecting member so that the first beverage container is attached to the second beverage container.

24 Claims, 15 Drawing Sheets

Related U.S. Application Data which is a continuation-in-part of application No. 13/111,454, filed on May 19, 2011, now Pat. No. 8,807,340.

(51) Int. Cl.
*A47G 19/22* (2006.01)
*B65D 21/02* (2006.01)
*B65D 77/00* (2006.01)

(52) U.S. Cl.
CPC ..... *B65D 21/0204* (2013.01); *B65D 21/0228* (2013.01); *B65D 21/0231* (2013.01); *B65D 77/003* (2013.01)

(58) Field of Classification Search
CPC ..... B65D 21/00; B65D 21/0222; B65D 21/0219; B65D 1/10; B65D 1/265; B65D 1/0276; B65D 77/003; B65D 77/06; B65D 77/0493; B65D 77/0486; B65D 77/2024; B65D 11/02; B65D 75/002; B65D 71/06; B65D 71/08; B65D 41/04
USPC ..... 206/499, 501, 502, 503, 505, 507, 217, 206/509, 515, 519, 520, 432; 220/359.1, 220/703; 215/6, 10
See application file for complete search history.

(56) References Cited

U.S. PATENT DOCUMENTS

| | | | | |
|---|---|---|---|---|
| 2,738,891 | A | 3/1956 | Pitto | |
| 2,747,387 | A | 5/1956 | Sweem | |
| 3,006,461 | A | 10/1961 | McGinnis | |
| 3,198,327 | A | 8/1965 | Boehling et al. | |
| 3,243,068 | A * | 3/1966 | Huston | 215/10 |
| 3,393,819 | A | 7/1968 | Van De Walle et al. | |
| 3,482,731 | A | 12/1969 | Douty | |
| 3,561,668 | A | 2/1971 | Bergstrom | |
| 3,684,123 | A | 8/1972 | Bridges | |
| 3,881,437 | A | 5/1975 | Lovell et al. | |
| 3,920,142 | A | 11/1975 | Vandrebeck et al. | |
| D242,416 | S | 11/1976 | Achenbach | |
| 4,382,506 | A | 5/1983 | Chaussadas | |
| 4,410,102 | A | 10/1983 | Lutzker | |
| 4,610,349 | A | 9/1986 | Schwartz et al. | |
| 4,679,699 | A | 7/1987 | Malsbury et al. | |
| 4,681,225 | A | 7/1987 | Schuster | |
| 4,685,565 | A | 8/1987 | Sparling | |
| 4,699,290 | A | 10/1987 | Adams | |
| 4,712,707 | A | 12/1987 | Pavely | |
| 4,848,579 | A | 7/1989 | Barnes et al. | |
| 4,883,675 | A | 11/1989 | Wernz | |
| 5,054,640 | A | 10/1991 | Tucker | |
| 5,067,612 | A | 11/1991 | Tsuchiya | |
| 5,110,002 | A | 5/1992 | Tucker | |
| 5,203,467 | A | 4/1993 | Tucker | |
| 5,240,132 | A | 8/1993 | Tucker | |
| 5,279,841 | A | 1/1994 | Yu | |
| D347,763 | S | 6/1994 | Kleckauskas et al. | |
| 5,452,818 | A | 9/1995 | Yost | |
| 5,462,169 | A | 10/1995 | Dygert | |
| D368,311 | S | 3/1996 | Cockram | |
| 5,573,133 | A * | 11/1996 | Park | 220/4.27 |
| D384,280 | S | 9/1997 | Kuczer | |
| D403,957 | S | 1/1999 | Bright et al. | |
| D404,256 | S | 1/1999 | Asberg | |
| 5,860,527 | A | 1/1999 | Frankenberg et al. | |
| D409,444 | S | 5/1999 | Pelz et al. | |
| 5,984,127 | A | 11/1999 | Fenton | |
| 6,065,603 | A | 5/2000 | Filice et al. | |
| 6,276,549 | B1 * | 8/2001 | Fasci et al. | 220/23.4 |
| 6,513,657 | B2 * | 2/2003 | Sheehan, Jr. | 206/497 |
| D479,436 | S | 9/2003 | Ortiz Gispert | |
| D484,361 | S | 12/2003 | Jeung | |
| 6,820,743 | B2 | 11/2004 | Hurley et al. | |
| D519,783 | S | 5/2006 | Lambert et al. | |
| D540,621 | S | 4/2007 | Wahl | |
| D547,201 | S | 7/2007 | Zeller | |
| D547,202 | S | 7/2007 | Herzog et al. | |
| D547,203 | S | 7/2007 | Herzog et al. | |
| D551,502 | S | 9/2007 | Bodum | |
| 7,273,147 | B2 | 9/2007 | Willat et al. | |
| D575,108 | S | 8/2008 | Barducci | |
| D577,547 | S | 9/2008 | Willat et al. | |
| D582,213 | S | 12/2008 | Kehrein et al. | |
| D595,096 | S | 6/2009 | Slay | |
| 7,806,284 | B2 * | 10/2010 | Mangano | 220/4.27 |
| D640,900 | S | 7/2011 | Jesseph | |
| D644,938 | S | 9/2011 | Saunders et al. | |
| 8,328,014 | B2 | 12/2012 | Saunders et al. | |
| 8,336,726 | B2 | 12/2012 | Ramsey et al. | |
| D674,236 | S | 1/2013 | Zimmer | |
| D674,237 | S | 1/2013 | Zimmer | |
| D674,238 | S | 1/2013 | Zimmer | |
| D674,243 | S | 1/2013 | Zimmer | |
| D703,068 | S | 4/2014 | Kick | |
| 2001/0032795 | A1 | 10/2001 | Weinstein et al. | |
| 2003/0029891 | A1 | 2/2003 | Alexander | |
| 2003/0221987 | A1 | 12/2003 | Trude | |
| 2004/0178161 | A1 * | 9/2004 | Galustyan | 215/11.1 |
| 2005/0092759 | A1 | 5/2005 | Willat et al. | |
| 2005/0139570 | A1 | 6/2005 | Lambert et al. | |
| 2005/0247661 | A1 | 11/2005 | Robertson | |
| 2006/0032855 | A1 | 2/2006 | Hinkle | |
| 2007/0012693 | A1 | 1/2007 | Kummer | |
| 2007/0119726 | A1 | 5/2007 | Willat et al. | |
| 2007/0144932 | A1 | 6/2007 | Willat et al. | |
| 2007/0158225 | A1 | 7/2007 | Stephens | |
| 2007/0193913 | A1 | 8/2007 | Schroeder | |
| 2008/0011748 | A1 | 1/2008 | Meyer et al. | |
| 2008/0023347 | A1 | 1/2008 | Wahl et al. | |
| 2008/0023348 | A1 | 1/2008 | Herzog et al. | |
| 2008/0047865 | A1 | 2/2008 | Willat et al. | |
| 2008/0083639 | A1 | 4/2008 | Peterman et al. | |
| 2008/0302692 | A1 | 12/2008 | Dubosq et al. | |
| 2009/0308771 | A1 | 12/2009 | Sparling et al. | |
| 2010/0025351 | A1 | 2/2010 | Fowler | |
| 2010/0072095 | A1 | 3/2010 | Salovaara | |
| 2010/0072164 | A1 | 3/2010 | Smith et al. | |
| 2010/0176022 | A1 | 7/2010 | Furlong | |
| 2010/0294770 | A1 | 11/2010 | Wing et al. | |
| 2010/0314274 | A1 | 12/2010 | Saunders et al. | |
| 2011/0132781 | A1 | 6/2011 | Willat et al. | |
| 2011/0174763 | A1 | 7/2011 | Kennedy | |
| 2011/0253720 | A1 | 10/2011 | Kick | |
| 2012/0045554 | A1 | 2/2012 | Carvin et al. | |
| 2013/0062238 | A1 | 3/2013 | Saunders et al. | |

FOREIGN PATENT DOCUMENTS

| | | | |
|---|---|---|---|
| FR | 2 554 786 | A1 | 5/1985 |
| GB | 1019346 | | 2/1966 |
| GB | 2303114 | A | 12/1997 |
| JP | H03-066833 | U | 6/1991 |
| JP | H03-097064 | U | 10/1991 |
| JP | 2000-153841 | A | 6/2000 |
| WO | WO 2007/056815 | A1 | 5/2007 |
| WO | WO 2009/152231 | A1 | 12/2009 |
| WO | WO 2010/106239 | A1 | 9/2010 |

OTHER PUBLICATIONS

Office Action regarding corresponding Chinese Patent Application No. 201280035501.2, dated Nov. 17, 2014, 18 pages.

English language translation Office Action regarding corresponding Chinese Patent Application No. 201280035501.2.

Partial translation of Office Action regarding corresponding Chinese Patent Application No. 201280035501.2 dated Jun. 9, 2015, 6 pages.

Office Action regarding corresponding Chinese Patent Application No. 201280035501.2 dated Jun. 9, 2015, 11 pages.

(56) References Cited

OTHER PUBLICATIONS

Machine translation of DE 296 22 585 U1, 8 pages.
Office Action regarding corresponding Chinese Patent Application No. 201280035501.2, dated Nov. 23, 2015, 11 pages and partial English language translation, 7 pages.
Office Action regarding corresponding Japanese Patent Application No. 2014-511543, dated Apr. 11, 2016, 4 pages and partial English language translation, 4 pages.
Office Action issued in related Australian Patent Application No. 2012255255 dated Feb. 20, 2017, 4 pages.
First Examination Report (6 pages) dated Nov. 7, 2018 from corresponding Australian Application No. 2017258987.
U.S. Appl. No. 13/111,454, filed May 19, 2011, Zimmer.
U.S. Appl. No. 29/411,983, filed Jan. 27, 2012, Zimmer.
U.S. Appl. No. 29/423,510, filed Jun. 1, 2012, Zimmer.
U.S. Appl. No. 29/423,578, filed Jun. 1, 2012, Zimmer.
U.S. Appl. No. 29/423,581, filed Jun. 1, 2012, Zimmer.
Office Action for U.S. Appl. No. 13/111,454, dated Aug. 7, 2012.
International Search Report and the Written Opinion for International Application No. PCT/US12/38380, dated Jul. 30, 2012.
Notice of Preliminary Rejection with English translation thereof (23 pages) dated Dec. 26, 2018 from corresponding South Korean Application No. 10-2013-7033801.
"Royalty Free Stock Photos: Yogurt pack. Isolated," available at http://www.dreamstime.com/royalty-free-stock-photos-yogurt-pack-isolated-image127855298 as of May 10, 2013, two pages.
"Custom Stack of Four," available at http://www.shop.vervacious.com/Custom-Stack-of-Four-Stack4.htm;jessionid=05A123C . . . as of May 10, 2013, one page.
"Vervacious," available at http://www.beachpackagingdesign.com/wp/2009/02/vervacious-love.html as love.html as of May 10, 20013, it is believed the design shown was publicly available at Vervacious as of Feb. 4, 2009, three pages.
"Hip Wine Glasses: Stack'em UP—PB Outdoor drinking glasses," available at http://www.dailyolive.com/2006/03/hip-wine-glass.html as of May 10, 2013, it is believed that glasses shown were publicly sold by Crate & Barrel as of Mar. 2006, two pages.
"Tableware—Spiegelau Authentis Beer Glasses," available at http://www.everten.com.au/Spiecielau-Authentis-Casual-Beer-Glasses.html as of May 10, 2013, two pages.
"Impilabile 250 ml Stacking Base Bottle," available at http://www.demijohn.co.uk.impilabile-250ml-stacking-bottle-base as of May 10, 2013, two pages.
"Double or Nothing—The Highland & Island Malt Whisky Stack," available at http://gearpatrol.com/2011/03/23/the-highland-island-malt-whisky-stack/ted-image127855298 as of May 10, 2013, it is believed to regard article published by Highland & Island on Mar. 23, 2011, seven pages.
"Clontarf Trinity Irish Whiskey," available at http://images.search.yahoo.com/search/images?_adv_prop=image&fr=yfp-t-900-s&va=clontarf+trinity+whiskey as of Apr. 29, 2013, one page.
"Dual Jar Tops the Competition," available at http://www.packworld.com/package-feature/safety/dual-jar-tops-competition as of Apr. 29, 2013, six pages.
"Mystic 500ml Stacking Bottle," available at http://www.demijohn.co.uk/mystic-500ml-stacking-bottle as of Apr. 29, 2013, two pages.
"Stackable Bottle," available at http://www.alibaba.com/product-free/216251136/Stackable_Bottle.html as of Apr. 29, 2013, two pages.
"Recylced-Glass Stacking Bottles," available at http://www.westelm.com/products/recycled-glass-stacking-bottles-a912/ as of Apr. 29, 2013, two pages.
"Stackable Bottles Filled with Greek Extra Virgin Olive Oil," available at http://www.abovegourmet.com/ol104.htm as of Apr. 29, 2013, two pages.
"Sauce—IM-50PP-1008-FL15," available at http://www.plasdene.com.au/category/product/cat1/Food/cat2/Glass/cat3/Bottle/cat4/Sauce/total/24/page/1/code/IM-50PP-1008-FL15 as of Apr. 29, 2013, one page.
"Personalised Gifts—Products—Stackable Bottles," available at http://www.marronliqueurs.co.uk/stackable-bottles as of Apr. 29, 2013, two pages.
Search results regarding trademark registration 2,996,209 regarding trademark pertaining to two stacked jars that were in commerce as of Sep. 26, 2004, three pages.
Search results regarding trademark registration 3,119,824 regarding trademark pertaining to three interlocking bottles that were in commerce as of Sep. 2003, two pages.
Search results regarding trademark registration 3,197,750 regarding trademark pertaining to two stacked glass jars that were in commerce as of Oct. 25, 2004, three pages.

* cited by examiner

BEVERAGE GLASS AND BEVERAGE GLASS ASSEMBLY

This application is a continuation-in-part application of 1) U.S. Design Pat. application Ser. No. 29/411,983, filed on Jan. 27, 2012 now U.S. Pat. No. D674,236, which is a continuation-in-part application of U.S. patent application Ser. No. 13/111,454, filed on May 19, 2011 now U.S. Pat. No. 8,807,340, and 2) U.S. patent application Ser. No. 13/111,454, filed on May 19, 2011, the entire contents of each of which are incorporated herein by reference.

BACKGROUND

The present invention is directed to a beverage container such as a wine glass that can be sealed with a seal or lid that can be removed prior to consumption. The present invention also relates to assemblies of multiple beverage containers in a direct connected, attached configuration.

Beverages are commonly sold to consumers in containers such as glass or plastic bottles, aluminum or steel cans, cardboard or plastic cartons; or devices that include bladders containing the beverage. The beverage contained therein can be transferred to a suitable drinking glass composed of a suitable material including but not limited to glass, plastic, or the like for consumption. In certain situations, users prefer drinking beverages from individual serving containers such as cans, juice bottles and the like. However, many consumers prefer drinking certain types of beverages from glasses having wide mouths to enhance the aroma and, therefore, the flavor of the beverage.

It would be desirable to provide individual servings of various beverages in sealed wide-mouth containers to enhance the aroma and taste of the beverage during consumption. It is also desirable to provide individual serving containers that can be positioned together into multi-serving container packages for sale or distribution.

SUMMARY

One aspect of the present invention regards a beverage container assembly including a first beverage container having a first vessel body that has a first base having a first perimeter and a first side wall connected to the first base, wherein the first side wall includes a connecting member. The first beverage container including a first rim defined on the first side wall distal to the first base. The assembly further including a second beverage container that includes a second vessel body that has a second base having a second perimeter and a second side wall connected to the second base. The second side wall includes an engagement member that engages with the connecting member so that the first beverage container is attached to the second beverage container.

A second aspect of the present invention regards an assembly that includes a first beverage container that has a first vessel body that has a first base having a first perimeter, a first side wall connected to the first base; and a first rim defined on the first side wall distal to the first base. The first beverage container includes a first lid having a first seal region, the first seal region removably attached to the first rim. The assembly further includes a second beverage container that has a second vessel body having a second base having a second perimeter, a second side wall connected to the second base and a second rim defined on the second side wall distal to the second base. The second beverage container is releasably engaged by the first base of the first beverage container such that the lid of said second container is interposed between the rim of the second container and the base of the first container. The second beverage container further includes a second lid having a second seal region, the second seal region removably attached to the second rim.

BRIEF DESCRIPTION OF THE DRAWINGS

The various features, advantages and other uses of the present apparatus will become more apparent by referring to the following detailed description and drawing in which.

DETAILED DESCRIPTION

Figure 1:
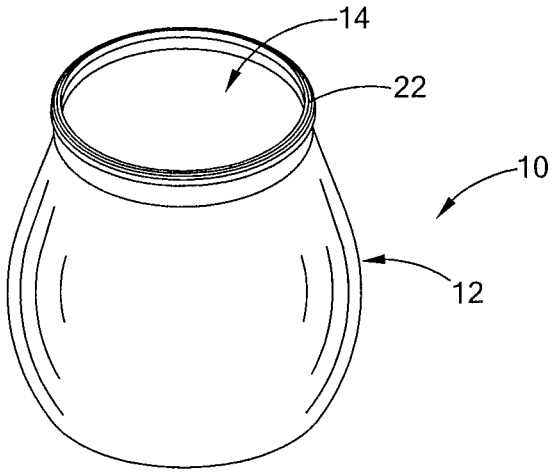
FIG. 1 is a perspective view of an embodiment of the beverage container as disclosed herein.

As shown in the exemplary drawing figures, and referring particularly for FIG. 1, a beverage container 10 includes a beverage vessel body 12 and a removable lid 14 sealingly affixed to the beverage vessel body 12. The beverage vessel body 12 can be constructed of any suitable material. In various embodiments, the beverage vessel body 12 can be made of a suitable moldable polymeric material. Where desired or required, the material can be transparent. In specific embodiments, the material employed can be any material that is suitable for use with food stuffs. The material can be one that is dimensionally stable, but can provide minor deformation in specific applications. In applications where the beverage container 10 contains wine, the beverage vessel body 12 can be composed of a suitable transparent polymeric material. The lid 14 can be made of any suitable material including, but not limited to, foil, plastic and the like. The material employed in the lid 14 can be made of a material that is the same or different from the material of the vessel body 12. In some applications, it is contemplated that the material employed in the lid 14 will be more deformable than that employed in the vessel body 12 and will be able to conform to suitable dimensional contours by crimping or the like.

Figure 7:
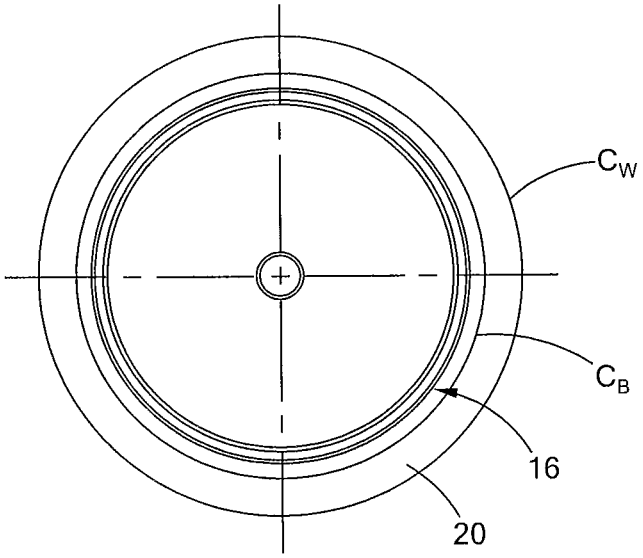
FIG. 7 is a bottom view of the beverage container of FIG. 1.

The beverage vessel body 12 includes a base 16 that has a circumference $C_B$ as measured at the outer perimeter of a surface contacting region that has of a first defined value (see FIG. 7). The beverage vessel body 12 also has a side wall 20 that terminates at a rim 22. The side wall 20 and base 16 define an interior chamber of a specified volume. As such, the side wall 20 will have a suitable height H. The side wall 20 also has a side wall median M as shown in FIG. 2.

In the embodiments depicted in the drawing figures, the side wall 20 has a curvilinear outer contour that creates at least one outwardly protecting bulbous region 24 that extends beyond the perimeter created by the base 16. The side wall 20 has an inwardly tapering region 26 immediately above bulbous region 24 as shown in FIG. 2. Tapering region 26 terminates at rim 22, the geometry of which will be described in greater detail subsequently. In the embodiment depicted, the side wall 20 has bulbous region 24 located below the side wall height median M. Bulbous region 24 has a circumference $C_W$ greater than the circumference $C_B$ of base 16 as shown in FIG. 7. The side wall 20 curves upward from base 16 to the circumference maxima at $C_W$. The side wall 20 then enters a gentle inward curve that proceeds contiguously into tapering region 26. Circumference maxima at $C_W$ can be any percentage greater than that of the circumference $C_B$ of base 16. In certain embodiments, it is contemplated that the circumference maxima $C_W$ can be between 10 and 50% greater than the circumference $C_B$ of base 16.

The side wall 20 has an inwardly tapering region 26 between the bulbous region 24 and the rim 22. In the embodiment depicted, the rim 22 has a circumference maxima $C_R$ equal to or less than the circumference $C_B$ of the base 16. In the embodiment depicted in the drawing figures, the outer circumference or circumference maxima $C_R$ of the rim 22 will be between 0 and 15% less than the circumference $C_R$ of base 16. In certain embodiments, the maximum circumference $C_W$ of side wall 20 will be between 5% and 50% greater than the circumference $C_B$ of base 16.

Figure 2:
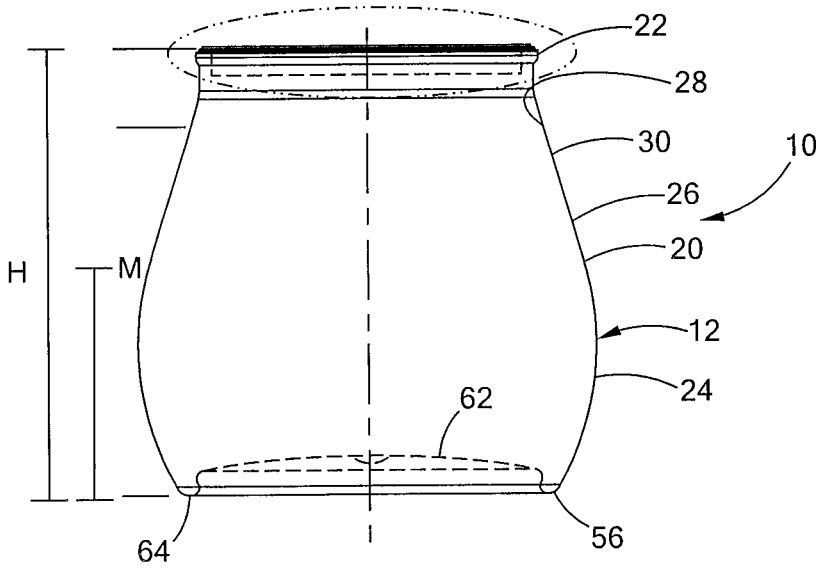
FIG. 2 is a side view of an embodiment of the beverage container of FIG. 1.
Figure 3:
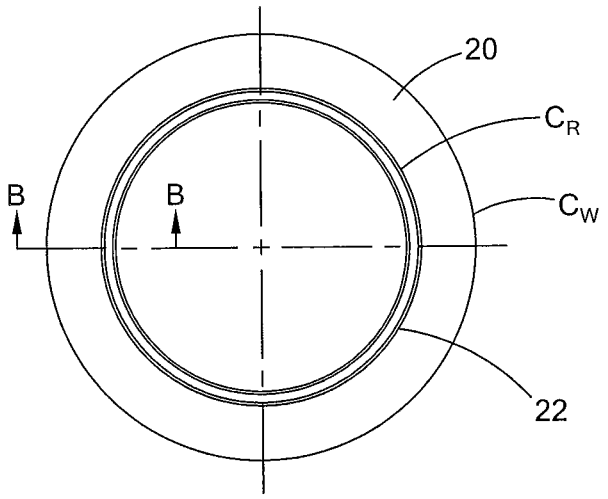
FIG. 3 is a top view of the beverage container of FIG. 1.

As shown in FIG. 2, side wall 20 can have a suitable inner face 28 opposed to a curvilinear outer face 30. In certain various embodiments, the inner and outer faces will be parallel. In the case of parallel inner and outer faces, the internal chamber defined in vessel body 12 will have greater volume in the regions below the median M.

The internal volume of the vessel body 12 contained in the internal chamber generally will be suitable to contain a suitable beverage serving. The vessel body 12 will be proportioned in a manner that provides the suitable volume. In certain embodiments, it is contemplated that the base 16 will have a cross-sectional diameter between 2 and 4 inches. The outer diameter of rim 22 will be sufficient to permit releasable engagement between rim 22 of one container 10 and base 16 of a second container. The inner diameter of the rim 22 will be sufficient to permit the beverage to be consumed from the vessel body 12. The maximum diameter of side wall 20 in the bulbous region 24 can be between ¼ inch and 1 inch greater than the diameter of base 16. The total height of the beverage container will be one that approximates the height of a 6 oz. beverage glass in certain applications.

Figure 5:
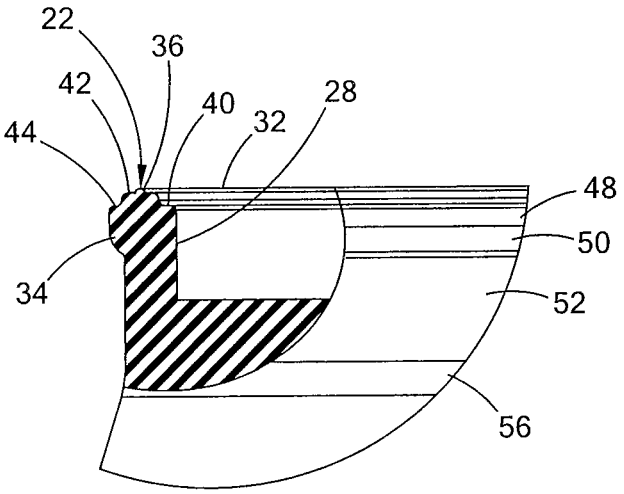
FIG. 5 is a cross-sectional view taken along the 5-5 line of FIG. 3.
Figure 6:
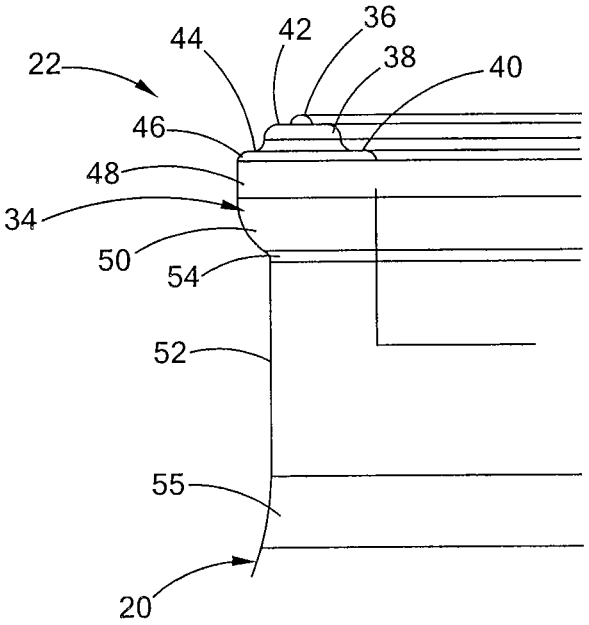
FIG. 6 is a detail view of an embodiment the rim portion of the beverage container of FIG. 1.

Rim 22 is contiguously joined to the upper region of side wall 20. As depicted in FIGS. 5-6, rim 22 includes a body 32 with a lip 34 projecting axially outward therefrom to a defined distance. In the embodiment depicted in the drawing figures, the lip 34 extends to provide an outer surface that can be received in a suitable orifice defined in the base 16 of a corresponding beverage vessel. In certain embodiments, the outer diameter of rim 22 is essentially equal to an inner diameter defined by base 16. The rim 22 also has an upwardly oriented surface that can include at least one upwardly oriented surface or bead 36 projecting therefrom.

Rim 22 is configured to be placed in mating contact with the lid 14 in a manner that facilitates establishment of a removed seal. Lid 14 can contact rim 22 in any suitable manner. In certain embodiments, the lid 14 is configured with a suitable edge region that is affixed to the rim 22 to maintain the beverage inside that vessel body 12. The lid 14 can be attached to the rim 22 in any suitable manner including, but not limited to, crimping adhesives and the like. Where an adhesive material is employed, the suitable adhesive material will be one that is suitable for use with food stuffs. The adhesive material can be present as a layer, bead, or other structure that is interposed between the rim 22 and the interior facing side of lid 14. Where desired or required, the interposed adhesive can be positioned such that it contacts all or a portion of the upper surface of rim 22, such as bead 36.

The lid 14 can have any suitable configuration to sealingly engage the rim 14 and span the opening defined in the vessel body 12. In various embodiments, the lid 14 can be a thin planar member that can conform to and cover the defined opening. For example, the lid 14 can be made of a foil-like material that has a tab that extends beyond the bead so that a user can grasp the tab and remove the lid 14. When in sealing engagement, the lid 14 can deflect inward into the opening defined in the vessel body 12. The lid 14 can have a suitable peripheral region proximate to its outer edge that can be configured to conform to at least a portion of the rim 22.

The desired beverage can be sealed in the vessel body 12 by lid 14. The volume of beverage will be such that the height of the beverage comes to a suitable fill line F. When the vessel body is composed of a suitable transparent polymeric material, the beverage will be visible through the vessel body 12. Note that besides liquids, the vessel body 12 can contain other types of objects, such as solid foods.

The rim 22 can have any configuration that will facilitate sealing engagement between the lid 14 and the vessel body 12. In one configuration, the rim 22 can include a generally vertical neck portion with a bead present at an end thereof. In another embodiment shown in FIGS. 5-6, the rim 22 can be configured with a plurality of steps 40, 42 positioned on interiorly and exteriorly oriented surfaces relative to bead 36. It is contemplated that adhesives or other sealing material can be interposed between the interiorly oriented steps 40, 42 and lid 14. As used herein the term "adhere" is taken to include connection facilitated by direct rim-to-lid adhesion as well as interposition of a suitable adhesive layer between the rim 22 and the lid 14. Where a line of adhesive is used, it is contemplated that the adhesive line can be deployed so as to contact the bead 36 of rim 22 and, if desired, the adhesive can be disposed such that the adhesive contacts multiple planar surfaces defined in the inwardly oriented surface of the rim 22.

It is also within the purview of this disclosure to configure lid 14 to conform to one or more of the geometric ridges and/or shelves defined in the upper surface of the rim 22. Conformance can be accomplished during manufacture of lid 14 or during attachment of lid 14 to associated rim 22. Conformance fitting may be augmented by adhesives where desired or required.

Figure 4:
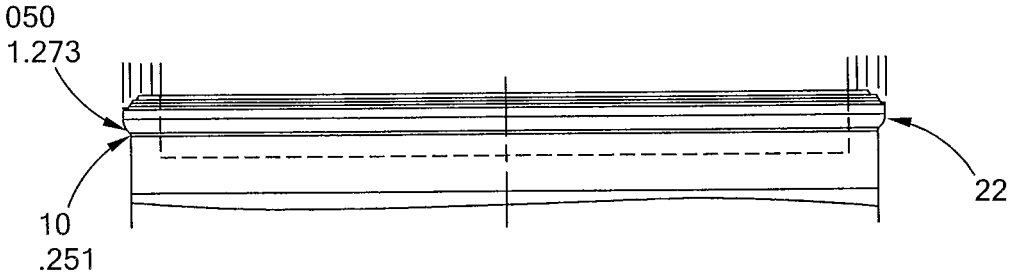
FIG. 4 is a detail view of an embodiment of a rim elevation of the beverage container of FIG. 1.

In the embodiment depicted in FIG. 4-6, the rim 22 has at least one shoulder 38 radially interior of the bead 36. The shoulder 38 is has a maximum height or peak below bead 36. Shelf 40 is located radially interior to shoulder 38 and is positioned contiguous thereto. Shelf 40 terminates in a downwardly projecting upper portion of inner wall 28.

Where desired or required, the rim 22 can have suitable outer geometric details. In the embodiment depicted in FIG. 4-6, the rim 22 has a shoulder 42 radially outward of bead 36 and positioned below the bead 36. A shelf 44 is positioned radially outward of and below the shoulder 42 and is contiguously joined to it. The contours of the various shelves 40, 44 and shoulders 38, 42 will be sufficient to permit contact with lid 14, but will be small enough to permit an enjoyable drinking experience.

While an adhesive attachment between the lid 14 and the associated rim 22 has been previously described, other types of attachment are possible. For example, an outer edge of the lid 14 could be crimped like a beer bottle cap so as to engage an exterior side of the rim 22. Another possibility is to slightly melt the top layer of the rim 22 and/or the bottom of the lid 14 prior to placing the lid 14 thereon so that a seal is formed between the lid 14 and rim 22.]

The outer edge 46 of shelf 44 defines a downwardly extending wall region 48 that terminates in an inwardly curved lower region 50. In the embodiment depicted in FIGS. 5-6, the inwardly curved lower region 50 terminates in a cylindrical band portion 52 that is interposed between the rim 22 and the uppermost portion of side wall 20. Side wall 20 and cylindrical band portion 52 can be contiguous to one another or can have a suitable intermediate region 54 interposed between them. In the embodiment depicted in the various drawing figures, an inwardly tapered is interposed between the intermediate region 54 inwardly curved lower region 50 and the cylindrical band portion 52.

The vessel body 12 can also include a transitional region 55 interposed between band portion 52 and the upper region of side wall 20.

Figure 8:
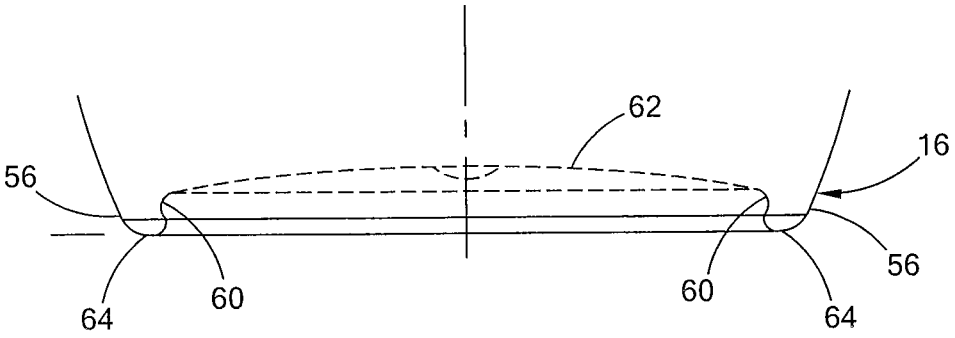
FIG. 8 is a detail view of the bottom region of the beverage container of FIG. 1
Figure 9:
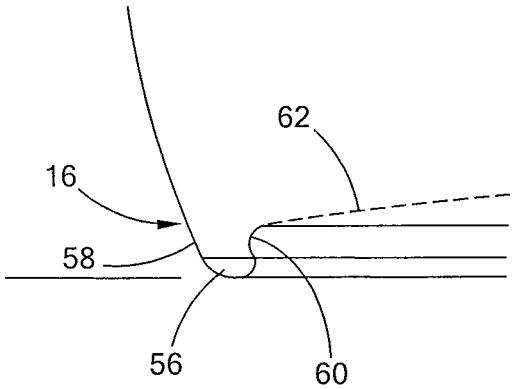
FIG. 9 is detail view of the lip region of the beverage container of FIG. 1.

The base 16 of vessel body 12 can be configured to releasably engage with rim 22 of a similarly configured beverage vessel 10. In the embodiment depicted in FIGS. 8-9, the base 16 includes at least one arm member 56 having an outwardly oriented side 58 contiguously connected to the lower region of the side wall 20 at a location on vessel body 12 opposed to the rim 22. The arm member 56 defines an inwardly oriented detent 60 generally opposed to outwardly oriented side 58 that terminates in bottom wall (shown in phantom in FIGS. 8 and 9). The size, number and positioning of arm member(s) 56 is sufficient to releasably engage the rim 22 of a corresponding beverage container 10. As depicted in FIGS. 7, 8 and 9, the device has one arm member 56 that extends continuously around the circumference of the base 16 and defines a surface contacting region 64.

The detent 60 can have any suitable internal wall configuration sufficient to receive and maintain at least a portion of rim 22 of an associated beverage device 10 in engaged relationship. In the embodiment depicted, the internal wall of detent 60 has a concave configuration that can releasably engage the corresponding rim 22. In the embodiment depicted, the inner wall of detent 60 contacts the shoulder 50 associated with rim 22.

The arm member 56 can be either of solid or hollow construction depending on the specific application. In the embodiment depicted in the drawing figures, arm member 56 is a continuous solid circular body contiguously positioned relative to side wall 20 and bottom surface 62. Without being bound to any theory, it is believed that the solid continuous arm member 56 provides stability to the associated vessel body 12. It is further believed that solid continuous arm member 56, when employed with solid rim 22 as further associated with curve linear side wall 20 provides a structurally robust beverage container 10.

The bottom surface 62 (shown in phantom in FIGS. 2, 8 and 9) can have any suitable geometric configuration. In the embodiment set forth in the drawing figures, the bottom surface 62 has an inwardly curved geometry having a lowest region proximate to arm member 56 and a maximum inwardly oriented point proximate to the radial center of the device 10. The arc defined by curved bottom surface 62 is between 1 degree and 30 degrees from planar.

Engagement between rim 22 and the arm member 56 generally occurs at a junction point located at a lower portion of detent 60 and rounded shoulder region 50 of the respective elements.

Figure 10:
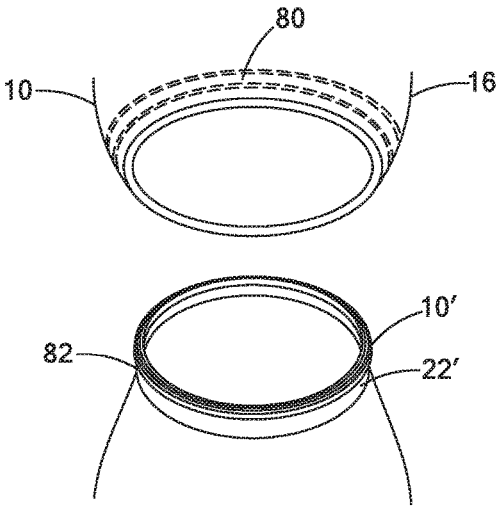
FIG. 10 schematically shows a second embodiment of a beverage container that engages another beverage container in accordance with the present invention.

Note that other connections between a base 16 of one beverage container 10 and a rim 22' of another beverage container 10' are possible. For example, an interior side surface of the base 16 of one beverage container 10 of FIGS. 1-9 can be altered to have a threaded pattern 80 that is threadedly engaged by a threaded pattern 82 formed on an exterior surface of the rim 22' of another beverage container 10' as shown in FIG. 10. Thus, the beverage containers 10 and 10' are screwed onto one another. Of course, the attachment scheme can be reversed where the threaded pattern 80 is formed on an exterior surface of the base 16 and the threaded pattern 82 is formed on an interior surface of the rim 22', the base 16 dimensioned so that the threaded patterns can engage one another. So, in summary, the bases and rims of each of the beverage containers 10, 10' of FIGS. 1-9 can be altered to include the threaded engagement disclosed above.

Figure 11:
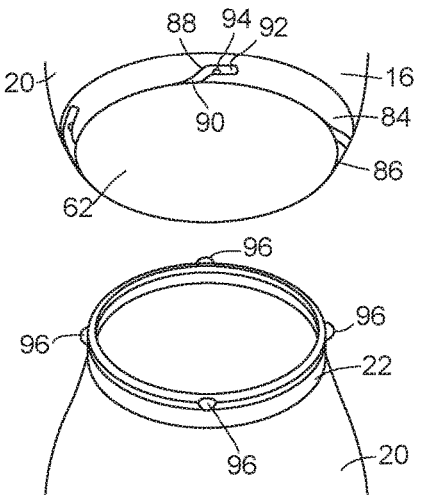
FIG. 11 schematically shows a third embodiment of a beverage container that engages another beverage container in accordance with the present invention.

Another possible attachment scenario is shown in FIG. 11. In particular, the base 16 of FIGS. 1-9 is altered so an interior surface 84 of a lower portion of the side wall 20 defines a vertical surface. A bottom surface 62 is formed above the bottom edge 86 of the interior surface. As shown in FIG. 11, a channel 88 is formed in the interior surface 84, wherein one end 90 of the channel 88 is formed at the bottom edge 86 so that access to the channel 88 at the bottom edge 86 is possible. The channel 88 rises at an angle from the bottom edge 86 and then levels off at another end 92. Before leveling off, the channel 88 includes a protrusion 94. The channel 88 and protrusion 94 are dimensioned and structured so that when a nub 96 formed on the rim 22 of another container moves along the channel 88, the nub 96 is trapped in end 92 after the nub 96 passes the protrusion 94.

With the above structure in mind, attachment of the rim 22 of one container to the base 16 of another container is accomplished by inserting the rim 22 of one container within the interior surface 84 of another container. Next, the two containers are rotated relative to one another in a first direction until a nub 96 on the rim 22 of one container is inserted into the channel 88 of the other container and passes the protrusion 94. The containers are effectively locked to one another until relative rotation between the two containers is performed in a direction opposite to the first direction. If sufficient torque is applied, the nub 96 will pass the protrusion 94 and be fed to the bottom edge of the container where the rim 22 can be released.

Figure 12:
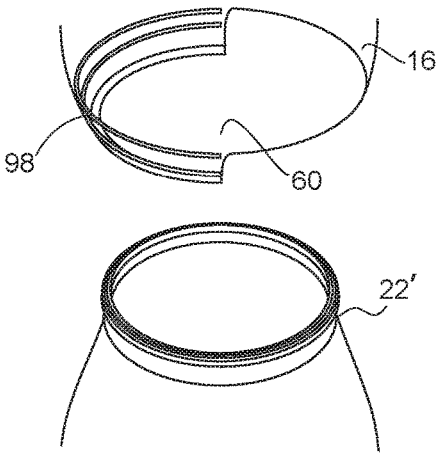
FIG. 12 schematically shows a perspective view of a fourth embodiment of a beverage container that engages another beverage container in accordance with the present invention.
Figure 12A:
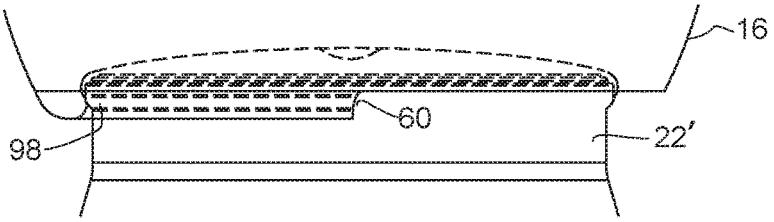
FIG. 12*a* schematically shows a front, partial cross-sectional view of the beverage container engaging a second beverage container of FIG. 12.
Figure 12B:
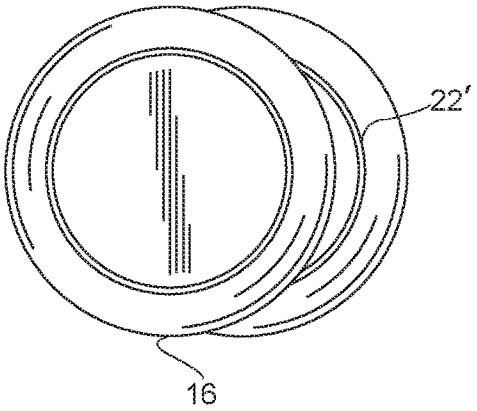
FIG. 12*b* schematically shows a top cross-sectional view of the beverage container engaging a second beverage container of FIG. 12.

Another possible attachment scenario is shown in FIGS. 12*a-b*. In particular, the base 16 of FIGS. 1-9 is altered so that lower portion at the bottom edge extends approximately 180° so as to be C-shaped. So, in practice, the lid 22' of one container is slid into the detent 60 until the rim 22' reaches the rear portion 98 of the base 16. The rim 22' and the base 16 are locked to one another by using a channel and nub system similar to that described with respect to FIG. 11. The structure of the channel formed in the interior of the side wall where the detent 60 is present is basically the same as that described with respect to the channel 88 of FIG. 11. One difference is that unlike protrusion 94 of FIG. 11, the protrusion is formed in the side of the channel 88 and not the bottom as shown in FIG. 11. With the above described channel described, locking between the rim 22' and the base 16 is accomplished by sliding the rim 22' into the detent 60 and then twisting the rim 22' and base 16 relative to one another until a nub formed in the rim 22' slides into the channel and rises up the channel until it moves over the protrusion into an end portion of the channel where the rim 22' and base 16 are locked. Twisting in the opposite direction with sufficient torque will release the nub from the channel in the manner similar to that described previously with respect to FIG. 11.

Figure 13:
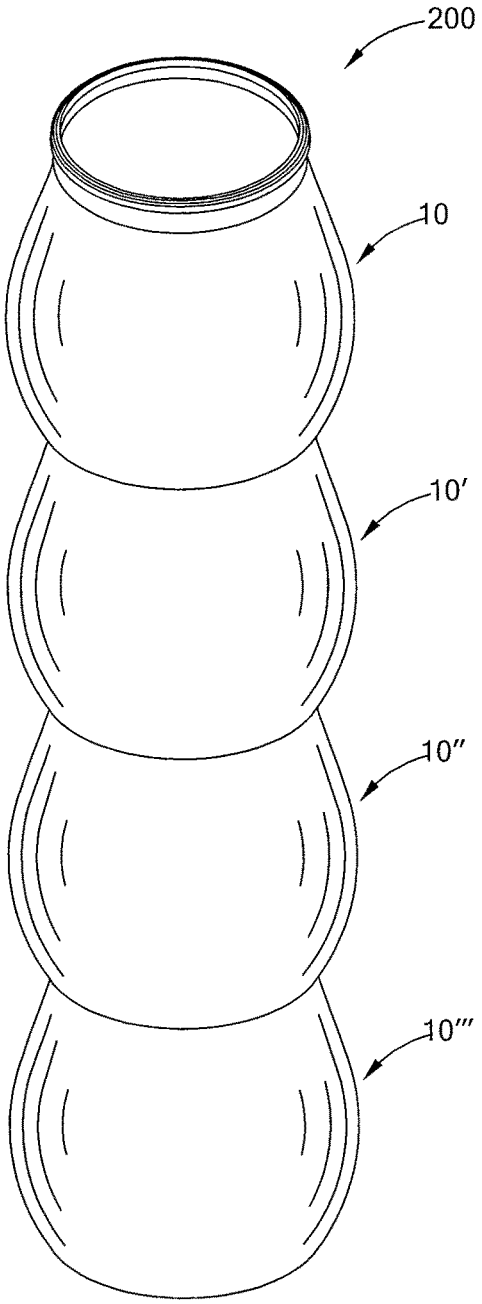
FIG. 13 is a perspective view an embodiment of a beverage container assembly as disclosed herein and in accordance with the present invention.
Figure 14:
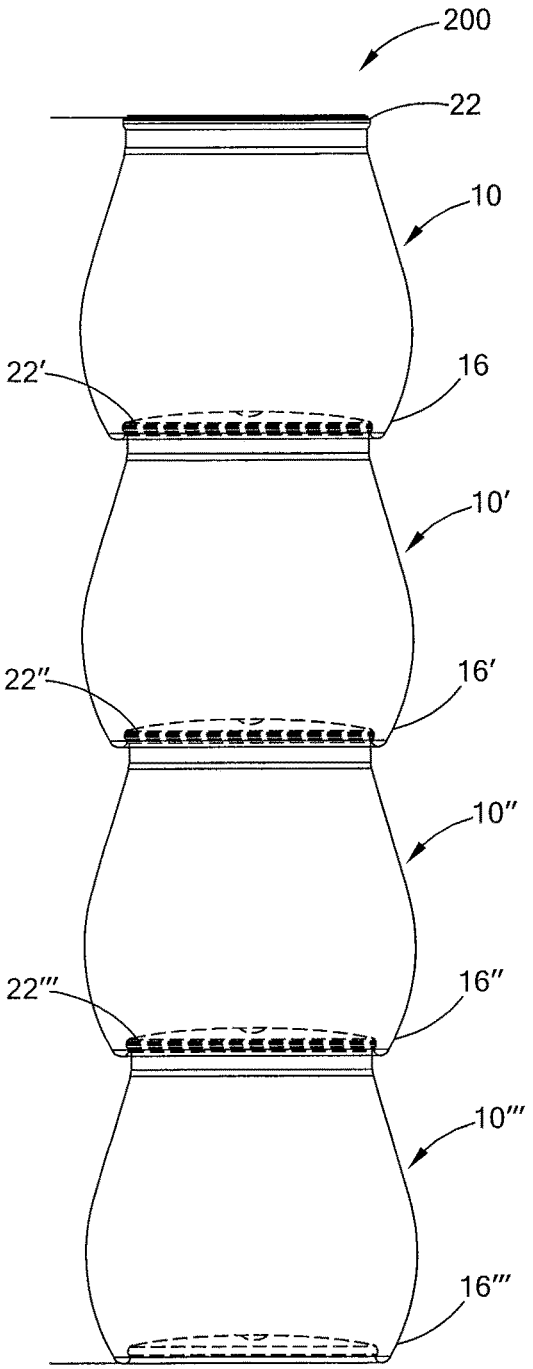
FIG. 14 is a front view of the beverage container assembly of FIG. 13.
Figure 15:
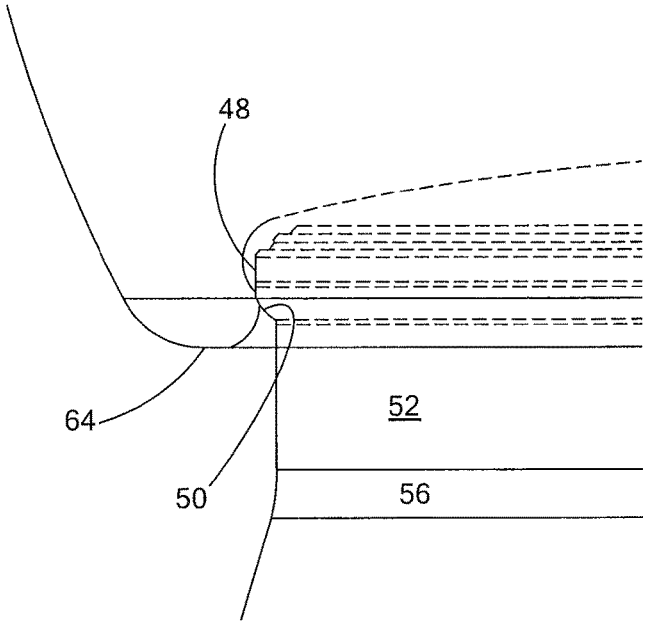
FIG. 15 is a detail view of the junction between two of the beverage containers in the beverage container assembly of FIG. 13.

The present disclosure contemplates an assembly of beverage containers such as those previously described the assembly including at least two beverage containers each having a vessel body 12 and a lid 14. An example of such an assembly when the beverage containers of FIGS. 1-9 are used is shown in FIGS. 13-15. Each beverage container 10 has a serving of a given beverage located in a sealed chamber defined in the vessel body 12. The serving size can be a predetermined amount. In applications were the beverage container 10 is configured to contain wine, the serving size can be between 2 oz. and 6 oz. by way of example. In the assembly 200, as depicted in FIGS. 14 and 15, the base 16 of at least one first beverage container 10 releasably engages the rim 22' of a second beverage container 10' such that a lid 14' of the second beverage container 10' is interposed between the respective rim 22' and base 16. In addition, note that the beverage container at the top of the stack may include a plastic cap to cover the lid.

The assembly 200 can be composed of any number of beverage containers 10, 10'. Certain assemblies can be composed of even multiples of beverage containers with assemblies of two and four being typical in certain applications. The assembly 200 of FIGS. 13-15 can further include an outer covering member. Non-limiting examples of outer covering include boxes and shrink wrap and the like.

Figure 16:
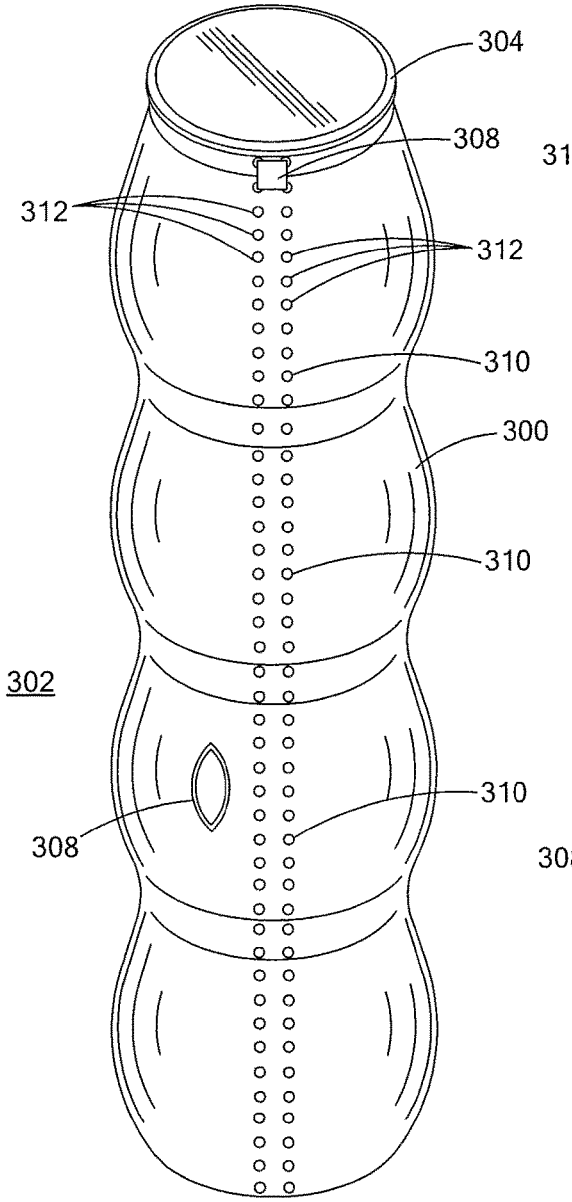
FIG. 16 is a perspective view an embodiment of a beverage container assembly system, wherein the beverage container assembly of FIG. 13 includes a removable cover in accordance with the present invention.
Figure 17:
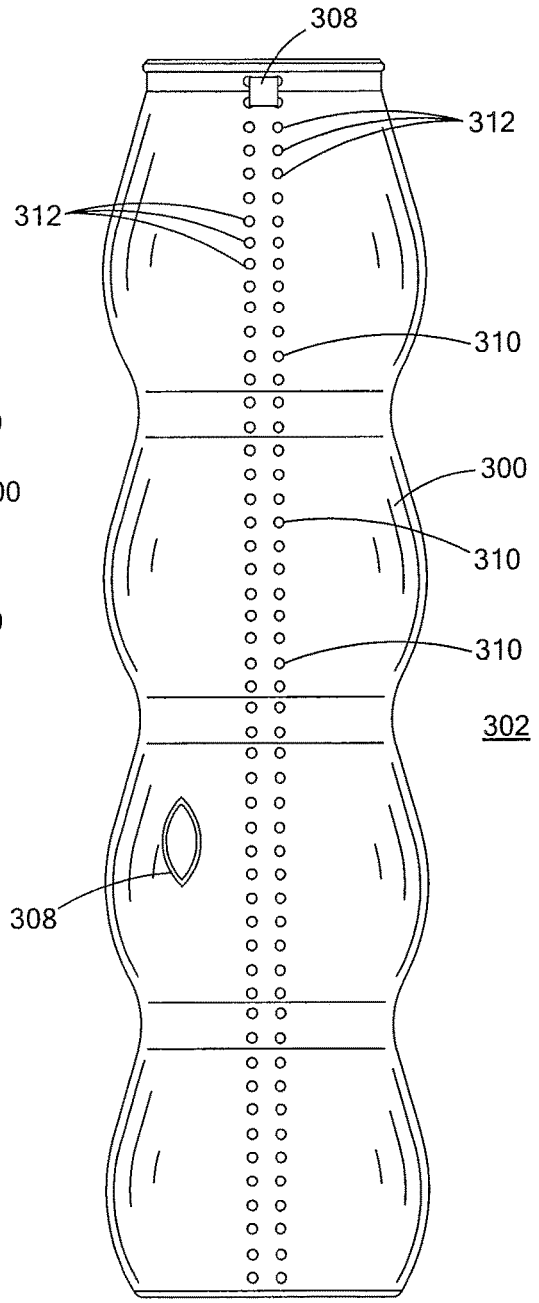
FIG. 17 is a front view of the beverage container assembly system of FIG. 16.
Figure 18:
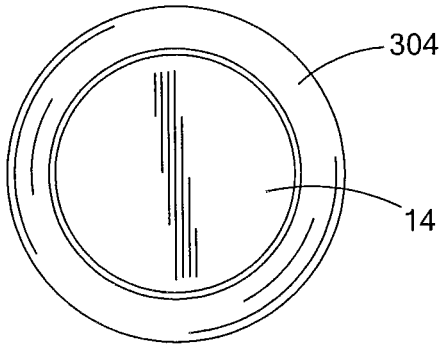
FIG. 18 is a top view of the beverage container assembly system of FIG. 16.
Figure 19:
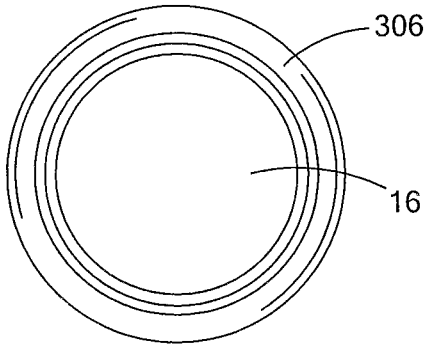
FIG. 19 is a top view of the beverage container assembly system of FIG. 16.

An example of a possible outer covering is shown in FIGS. 16-19. The outer covering 300 is made of a flexible, plastic material, such as PET, that has an opening at both ends thereof. The assembly 200 of FIGS. 13-15 is inserted bottom end first through the opening so that the covering 300 and assembly 200 define a covered assembly of beverage containers 302. In the case of using PET for covering 300, the covering 300 and assembly combination are placed in a steam tunnel or the like, which results in the covering shrinking and taking on the shape of the assembly of beverage containers As shown in FIGS. 16-17, the material takes on the exterior shape of the assembly 200 along the sides. At the top, an annular ring may be formed around the outer edge of the plastic cap attached to the lid 14 and rim 22. At the bottom, an annular portion 306 is centered about the center of the base 16. Note that the covering 300 may contain various features. For example, the covering 300 may include an opening 308 so that an observer can determine the contents within the covering 300. The covering 300 may include an opening device 310 that includes an area that extends along the length of the assembly 302 and the area is so weakened that when a user pulls on a tab area 308 at the top and along the length of the opening device the area breaks apart to reveal the beverage containers therein. As shown in FIGS. 16-17, the area includes two parallel lines of holes, wherein each hole 312 is approximately 1 mm in diameter and there are about 7 holes per every centimeter along the length of the area. As shown in FIGS. 16-17, each hole 312 is defined by a circular free edge formed in the covering 300. The lines of holes are separated from one another by approximately 8 mm. When the tab area 308 is pulled downward, the material along one of the lines of holes and between the holes of that line is broken apart. The same process occurs with the other line of holes so that a slit-like opening is formed between the lines of holes.

The beverage containers 10, 10' etc. can be dimensioned to approximate the height and maximum width dimensions of a standard wine bottle. Thus an assembly 200 of four beverage containers 10, 10', 10", 10'" positioned in stacked end-to-end relationship will have the approximate height of a standard wine bottle. The assembly can contain four servings of the same or different wines. Each container can be accessed by removing the respective lid. The contents can be consumed from the opened beverage container which can be used as a drinking glass.

Figure 20:
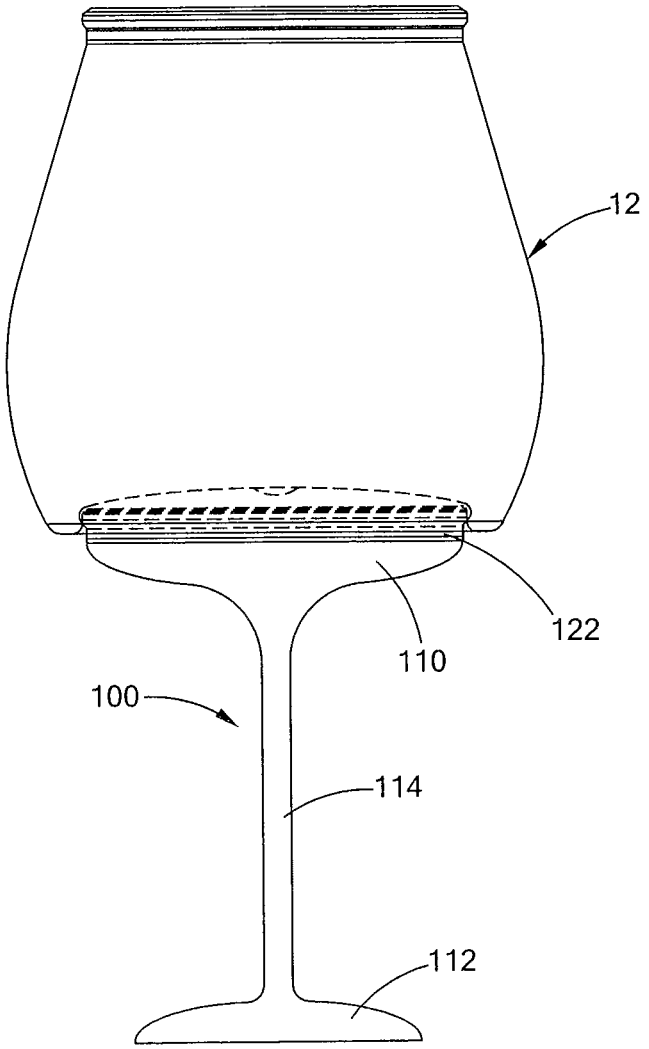
FIG. 20 is a side view of a beverage container as disclosed herein as an assembly with an embodiment of a removable beverage container accessory.
Figure 21:
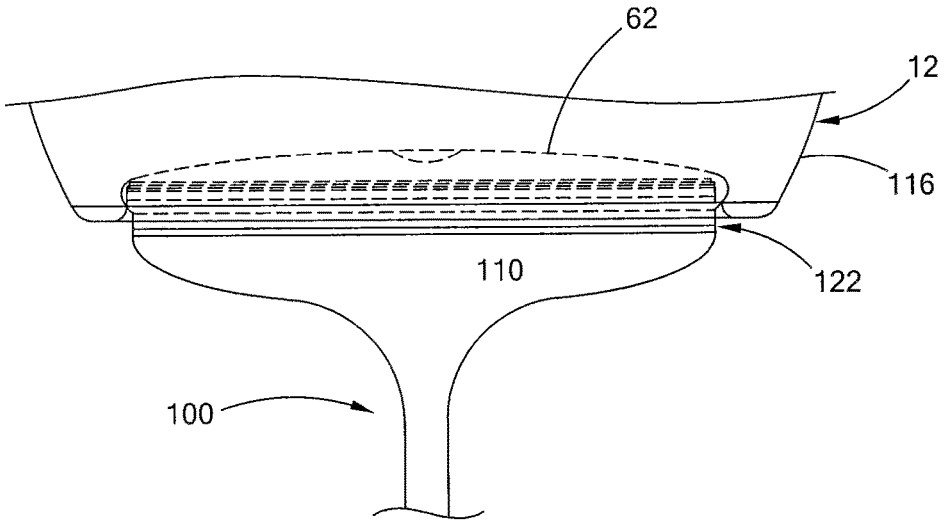
FIG. 21 is a detail view of the assembly of FIG. 20.

While the present disclosure has presented engagement between two beverage containers 10, it is also considered within the purview of the present disclosure to provide releasable engagement between a beverage container 10 and a suitable accessory. One non-limiting example of a suitable accessory to be engaged by the beverage container 10 of FIGS. 1-9 is wine glass support 100 depicted in FIGS. 20 and 21. Wine glass support 100 includes a suitable head 110, base 112 and stem 114 interposed between head 110 and base 112. Head 110 is configured to releasably engage a suitably configured base 16 of beverage container 10. In the embodiment depicted, head 110 of wine glass support 100 includes a suitable rim 122 configured to matingly contact arm member(s) 56. In the embodiment illustrated, rim 122 is matingly received in the orifice defined by continuous circular arm member 56 in the manner described previously. Other accessories are contemplated, including but not limited to Pilsner stems as well as plate members and the like.

When the beverage container 10 is employed with an accessory such as wine glass support 100, the support 100 can be attached when desired. Typically the support 100 will be attached to base 16 of beverage container 10 prior to removal of lid 14.

Figure 22:
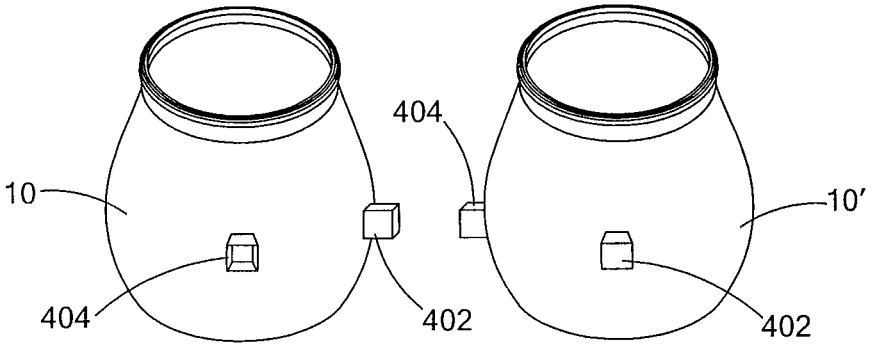
FIG. 22 is a perspective view of the containers of FIGS. 10-15 altered to have connecting members and engagement members.

As previously described with respect to the beverage containers 10 and system 200 of FIGS. 1-15, attachment between the lids/rims of one container with the base of another container are possible. Further attachments are possible. As shown in FIG. 22, it is contemplated that the container 10 of FIGS. 1-15 are adapted to include one or more connecting members 402 on the side wall 20. Such connecting members 402 are adapted to engage with engagement members 404 of another container 10'. For example, it is contemplated that connecting member 402 would be a male member of a snap and attachment member 404 would be a corresponding female member of the snap. Of course other engagement structures for members 402 and 404 are possible.

Figure 23:
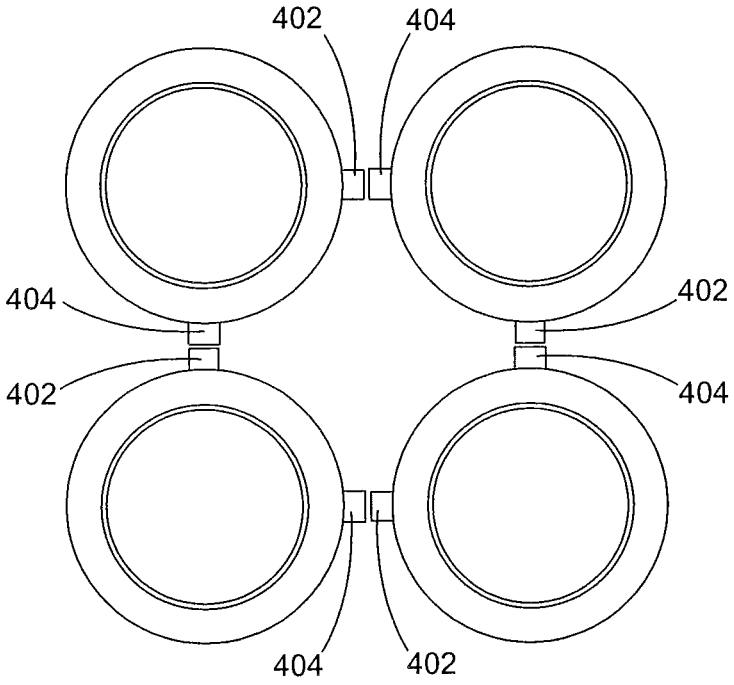
FIG. 23 is a top view of a first possible configuration of four beverage containers of FIGS. 1-15 using the connecting and engagement members of FIG. 22.
Figure 24:
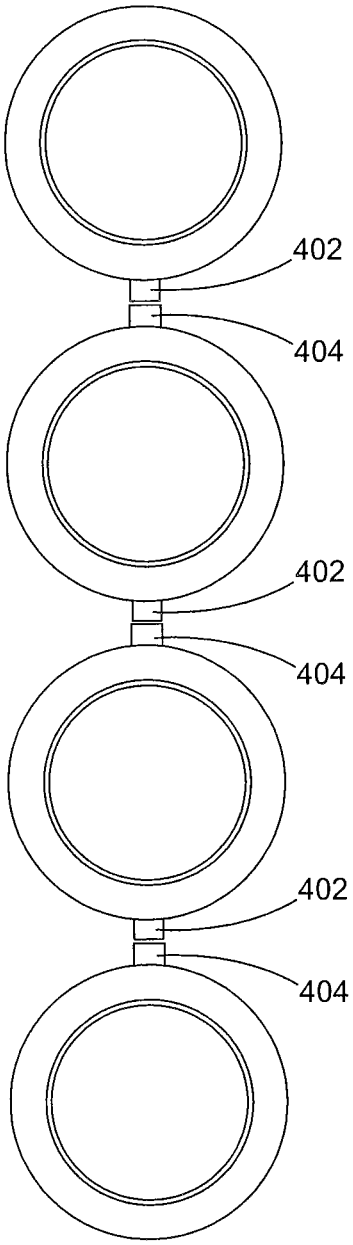
FIG. 24 is a top view of a second possible configuration of four beverage containers of FIGS. 1-15 using the connecting and engagement members of FIG. 22.

Note that the above described side engagement allows for a variety of packaging configurations, one of which is shown in FIG. 23. Another pattern would be to connect each container 10 side-to-side along a line using members 402 and 404 as shown in FIG. 24. If one of the unattached sides had a sufficient shape, such as a flat surface, the entire line of attached containers could be rotated so that the previously mentioned unattached side was placed on a surface so that the line of containers extended vertically from that surface so as to define a stack similar to those shown in FIGS. 13 and 14.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An assembly comprising:

a first beverage container comprising:

a first vessel body comprising:

a first base having a first perimeter;

a first side wall connected to said first base; and a first rim defined on said first side wall distal to said first base, a first lid having a first seal region, said first seal region removably attached to an upper surface of said first rim, wherein said first seal region contacts and releasably engages an adhesive located between said first lid and said upper surface of said first rim; and a second beverage container comprising:

a second vessel body comprising:

a second base having a second perimeter;

a second side wall connected to said second base; and a second rim defined on said second side wall distal to said second base, wherein said first beverage container is releasably engaged by said second base of said second beverage container such that said first lid of said first container is interposed between said first rim of said first container and said second base of said second container; and a second lid having a second seal region, said second seal region removably attached to said second rim; and a cover that encloses said first beverage container and said second beverage container, said cover comprising an opening device that when manually operated provides access to at least one of said first beverage container and said second beverage container.

2. The assembly of claim 1, wherein said first rim comprises a threaded pattern that engages a threaded pattern formed on said second base.

3. The assembly of claim 1 wherein said second base comprises a channel that slidingly receives a male element formed on said first rim.

4. The assembly of claim 3, wherein said male element is locked in position within said channel.

5. The assembly of claim 3, wherein said channel comprises a protrusion, such that when said male element passes said protrusion said male element is locked in position within said channel.

6. The assembly of claim 1 wherein said first lid is slidingly received in a channel formed in said second base.

7. The assembly of claim 6, wherein said first lid is locked in position within said channel.

8. The assembly of claim 1, wherein said first beverage container and said second beverage container each include a serving of wine.

9. The assembly of claim 1, wherein said opening device comprises two lines of holes formed in said cover and a tab area formed in said cover, wherein said two lines of holes extend from a first position opposite said first base of said first container to a second position opposite said second container and wherein said holes and said tab area are structured so that when said tab area is pulled downward material along at least one of said lines of holes and between said holes of said line are broken apart so that a slit-like opening is formed between said lines of holes and extends from said first position to said second position, and wherein each of said holes is defined by a circular free edge.

10. The assembly of claim 9, wherein said cover defines an opening that receives said second rim therethrough.

11. The assembly of claim 9, wherein said cover defines an opening that receives said first base therethrough.

12. The assembly of claim 9, wherein said two lines of holes are parallel to one another.

13. The assembly of claim 9, wherein each of said holes is approximately 1 mm in diameter.

14. The assembly of claim 9, wherein said two lines of holes extend from said first base to said second rim.

15. The assembly of claim 14, wherein each of said two lines comprises greater than nine holes.

16. The assembly of claim 14, wherein each of said holes is approximately 1 mm in diameter.

17. The assembly of claim 14, wherein for one of said two lines there are about seven holes per every centimeter.

18. The assembly of claim 17, wherein each of said holes is approximately 1 mm in diameter.

19. The assembly of claim 9, wherein said tab area is approximately located adjacent to said second rim.

20. An assembly comprising:

a first beverage container comprising:

a first vessel body comprising:

a first base having a first perimeter;

a first side wall connected to said first base; and a first rim defined on said first side wall distal to said first base, a first lid having a first seal region contacting an upper surface of said first rim and providing access to an interior of said first vessel body, wherein said first seal region contacts and releasably engages an adhesive located between said first lid and said upper surface of said first rim; and a second beverage container comprising:

a second vessel body comprising:

a second base having a second perimeter;

a second side wall connected to said second base; and a second rim defined on said second side wall distal to said second base, wherein said first beverage container is contacted by said second base of said second beverage container such that said first lid of said first container is interposed between said first rim of said first container and said second base of said second container; and a second lid having a second seal region, said second seal region removably attached to said second rim; and a cover that encloses said first beverage container and said second beverage container, said cover comprising an opening device that when manually operated provides access to at least one of said first beverage container and said second beverage container, wherein said opening device comprises two lines of holes formed in said cover and a tab area formed in said cover, wherein said two lines of holes extend from a first position opposite said first base of said first container to a second position opposite said second container and wherein said holes and said tab area are structured so that when said tab area is pulled downward material along at least one of said lines of holes and between said holes of said line are broken apart so that a slit-like opening is formed between said lines of holes and extends from said first position to said second position, and wherein each of said holes is defined by a circular free edge; and wherein said cover defines an opening that receives said second rim therethrough.

21. An assembly comprising:

a first beverage container comprising:

a first vessel body comprising:

a first base having a first perimeter;

a first side wall connected to said first base; and a first rim defined on said first side wall distal to said first base, a first lid having a first seal region contacting an upper surface of said first rim and providing access to an interior of said first vessel body, wherein said first seal region contacts and releasably engages an adhesive located between said first lid and said upper surface of said first rim; and a second beverage container comprising:

a second vessel body comprising:

a second base having a second perimeter;

a second side wall connected to said second base; and a second rim defined on said second side wall distal to said second base, wherein said first beverage container is contacted by said second base of said second beverage container such that said first lid of said first container is interposed between said first rim of said first container and said second base of said second container; and a second lid having a second seal region, said second seal region removably attached to said second rim; and a cover that encloses said first beverage container and said second beverage container, said cover comprising an opening device that when manually operated provides access to at least one of said first beverage container and said second beverage container, wherein said opening device comprises two lines of holes formed in said cover and a tab area formed in said cover, wherein said two lines of holes extend from a first position opposite said first base of said first container to a second position opposite said second container and wherein said holes and said tab area are structured so that when said tab area is pulled downward material along at least one of said lines of holes and between said holes of said line are broken apart so that a slit-like opening is formed between said lines of holes and extends from said first position to said second position, and wherein each of said holes is defined by a circular free edge; and wherein said cover defines an opening that receives said first base therethrough.

22. An assembly comprising:

a first beverage container comprising:

a first vessel body comprising:

a first base having a first perimeter;

a first side wall connected to said first base; and a first rim defined on said first side wall distal to said first base, a first lid having a first seal region contacting an upper surface of said first rim and providing access to an interior of said first vessel body, wherein said first seal region contacts and releasably engages an adhesive located between said first lid and said upper surface of said first rim; and a second beverage container comprising:

a second vessel body comprising:

a second base having a second perimeter;

a second side wall connected to said second base; and a second rim defined on said second side wall distal to said second base, wherein said first beverage container is contacted by said second base of said second beverage container such that said first lid of said first container is interposed between said first rim of said first container and said second base of said second container; and a second lid having a second seal region, said second seal region removably attached to said second rim; and a cover that encloses said first beverage container and said second beverage container, said cover comprising an opening device that when manually operated provides access to at least one of said first beverage container and said second beverage container, wherein said opening device comprises two lines of holes formed in said cover and a tab area formed in said cover, wherein said two lines of holes extend from a first position opposite said first base of said first container to a second position opposite said second container and wherein said holes and said tab area are structured so that when said tab area is pulled downward material along at least one of said lines of holes and between said holes of said line are broken apart so that a slit-like opening is formed between said lines of holes and extends from said first position to said second position, and wherein each of said holes is defined by a circular free edge; and wherein said two lines of holes extend from said first base to said second rim, and wherein each of said two lines comprises greater than nine holes.

23. An assembly comprising:

a first beverage container comprising:

a first vessel body comprising:

a first base having a first perimeter;

a first side wall connected to said first base; and a first rim defined on said first side wall distal to said first base, a first lid having a first seal region contacting an upper surface of said first rim and providing access to an interior of said first vessel body, wherein said first seal region contacts and releasably engages an adhesive located between said first lid and said upper surface of said first rim; and a second beverage container comprising:

a second vessel body comprising:

a second base having a second perimeter;

a second side wall connected to said second base; and a second rim defined on said second side wall distal to said second base, wherein said first beverage container is contacted by said second base of said second beverage container such that said first lid of said first container is interposed between said first rim of said first container and said second base of said second container; and a second lid having a second seal region, said second seal region removably attached to said second rim; and a cover that encloses said first beverage container and said second beverage container, said cover comprising an opening device that when manually operated provides access to at least one of said first beverage container and said second beverage container, wherein said opening device comprises two lines of holes formed in said cover and a tab area formed in said cover, wherein said two lines of holes extend from a first position opposite said first base of said first container to a second position opposite said second container and wherein said holes and said tab area are structured so that when said tab area is pulled downward material along at least one of said lines of holes and between said holes of said line are broken apart so that a slit-like opening is formed between said lines of holes and extends from said first position to said second position, and wherein each of said holes is defined by a circular free edge; and wherein said two lines of holes extend from said first base to said second rim, and wherein for one of said two lines there are about seven holes per every centimeter.

24. The assembly of claim 23, wherein each of said holes is approximately 1 mm in diameter.

* * * * *